United States Patent [19]

Volk

[11] 4,160,203

[45] Jul. 3, 1979

[54] AUTOMOTIVE SPARK INDICATOR

[75] Inventor: Richard G. Volk, York, Pa.

[73] Assignee: K-D Manufacturing Company, Lancaster, Pa.

[21] Appl. No.: 859,435

[22] Filed: Dec. 12, 1977

[51] Int. Cl.[2] ..... F02P 17/00

[52] U.S. Cl. ..... 324/15

[58] Field of Search ..... 324/17, 15, 18

[56] References Cited

U.S. PATENT DOCUMENTS

| | | | |
|---|---|---|---|
| 2,076,618 | 4/1937 | Cooper | 324/17 |
| 2,317,263 | 4/1943 | Egan | 324/17 |
| 2,482,016 | 9/1949 | McCoy | 324/17 |
| 2,842,017 | 9/1949 | McCoy | 324/17 |
| 3,044,011 | 7/1962 | Walker | 324/15 |
| 3,441,797 | 4/1969 | Lewis | 324/17 |
| 3,979,664 | 9/1976 | Harris | 324/17 |

FOREIGN PATENT DOCUMENTS

| | | | |
|---|---|---|---|
| 269370 | 4/1927 | United Kingdom | 324/17 |
| 1327590 | 8/1973 | United Kingdom | 324/15 |

*Primary Examiner*—Stanley T. Krawczewicz
*Attorney, Agent, or Firm*—Paul & Paul

[57] ABSTRACT

A spark indication apparatus connectable between the secondary winding tower of an ignition coil or a spark plug distribution tower of an auto distributor or a spark plug wire coming from the distributor, and chassis ground having, preferably, a transmission cable including two separated portions, the intermittent connection thereof may provide a spaced air gap or spark gap space for the generation of an electric spark by current passing through the transmission cable; and having a housing which may encase part of each transmission cable portion and the spark gap space, this housing preferably having a cavity defining a spark chamber, wherein the spark chamber may be vented to the atmosphere through the housing.

10 Claims, 5 Drawing Figures

AUTOMOTIVE SPARK INDICATOR

BACKGROUND OF THE INVENTION

When an automotive motor will not start or runs irratically, the first item an auto mechanic looks to is the ignition system. Of primary importance to the operation of an ignition system is the spark to the spark plugs or ignitors. Invariably a mechanic will check the spark when testing an ignition system.

In the past, automotive spark has been tested by removing the spark plug holding the plug against the engine to complete the spark plug circuit while the engine is cranking, and observing the presence and quality of a spark across the plug electrode gap. A second method has been to remove a spark plug wire from a spark plug and to hold this wire in close proximity to the engine block while the engine is cranking to observe the presence and quality of a spark between the end of the wire and the engine block. Both of these methods utilize a rather make-shift procedure to perform the test. Moreover, both procedures subject the mechanic to a shock hazard. Very often, auto mechanics who almost never wear electrically insulated gloves when working on automobiles, will receive a shock either through the insulation surrounding the spark plug wire or from coming in contact with metal portions of a spark plug or by coming in contact with a conductive portion of the spark plug wire. Electrical agitation "shock" received through spark plug insulation is uncomfortable and annoying to the mechanic. Electrical shock received directly from a conductor in contact with the conductive portion of the spark plug wire can cause excessive discomfort and even create a severe health hazard to the mechanic.

In addition to the health hazard, the make-shift tests described above provide a imprecise way of observing the spark. It is well known that the true evaluation of ignition spark is only obtained under realistic spark conditions. This means that the spark gap should be of a predetermined fixed distance and in a position where the mechanic can readily observe it. The make-shift holding of the spark plug against the engine block or the holding of the spark plug wire in close proximity to the engine block where there is a subjective and imprecise distance between the end of the wire and the engine block are rather unsatisfactory methods of testing ignition spark. Moreover, a good ground is not always established. A poor ground will alter the condition of the spark.

The testing of the quality of ignition spark becomes more important with the advent of electronic ignition systems. These electronic ignition systems provide high performance and exacting standards of operation for ignition of automotive motors. No prior art devices are known to be directed precisely to the structure and operation of an ignition spark indicator apparatus.

What is desired therefore, is a spark indicator apparatus which provides a safe alternative to the mechanic disconnecting a spark plug wire and holding it in close proximity to the engine block. Moreover, such an indicator must signal the presence and quality of a spark adequately for a mechanic to make an analysis under the relatively noisy and relatively darkened working conditions found typically in automotive repair shops.

An object of this invention is to provide an apparatus specifically designed for the determination of the presence of an automotive ignition spark.

Another object of this invention is to provide such a spark indicator which indicator provides a visual and audio indication of the spark.

A further object of this invention is to provide such a spark indicator apparatus having its outer surfaces completely enclosed and insulated for protecting the auto mechanic handling the apparatus from electrical shock hazard.

A further object of this invention is to provide such a spark indicator apparatus having a precise and predetermined spark gap for permitting a spark of predetermined length.

An even further object of this invention is to provide such a spark indicator apparatus having connectors for establishing good ground and ignition current connections.

SUMMARY OF THE INVENTION

The objectives of this invention are realized in a spark indicator apparatus for testing the existence and quality of an automotive spark signal present in the secondary winding tower of the ignition coil, the distribution towers of the distributor, and a spark plug wire connecting to an auto spark plug or ignitor. The ignition spark signal transmission may be interrupted at any of these locations and the spark indicator apparatus installed between that location and chassis ground for transmitting ignition current directly to ground.

The indicator apparatus may include a transmission cable having two portions, a free end of each portion being fitted with a connector for mating the spark indicator to the ignition system at the point of interruption and mating to chassis ground, respectively. The other free ends of the transmission cable may be spaced apart in alignment with one another to provide a spark gap therebetween. This spark gap may be of a predetermined and fixed distance.

A housing may encase the spark gap and associated ends of the transmission cable portions. This housing may contain a cavity defining a spark chamber of fixed dimensions surrounding the spark gap. The spark chamber may have a port and passageway connected thereto, this passageway extending through the housing, may vent the spark chamber to the atmosphere.

The housing may be constructed of opaque or transparent electrically non-conductive material and may have rounded or curved surface areas which magnify or otherwise alter the visual perspective of the spark seen therethrough. Electrical insulation may be provided on the connectors and the transmission cable portions.

DESCRIPTION OF THE DRAWINGS

The features of operation and advantages of this invention will be easily understood from the reading of the following detailed description in connection with the attached drawings in which like reference numerals refer to like elements, and in which.

DETAILED DESCRIPTION

Figure 1:
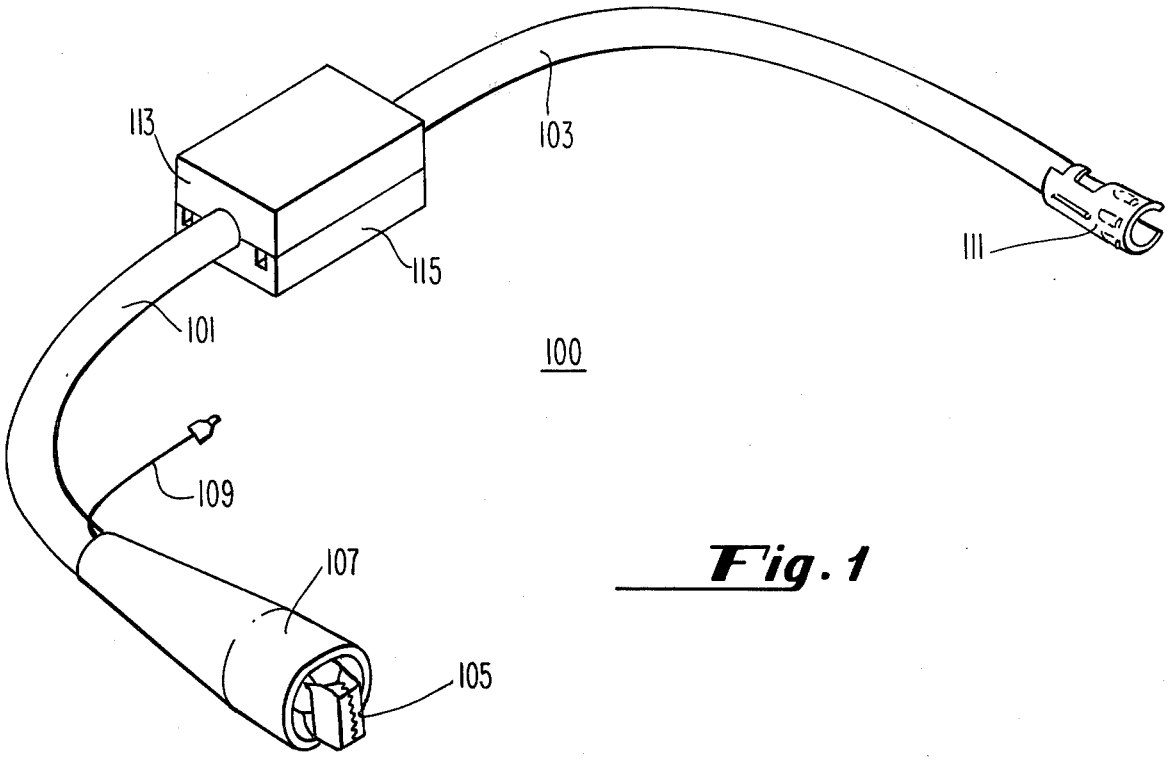
FIG. 1 is a perspective view of the spark indicator apparatus.

An automotove spark indicator apparatus 100, FIG. 1, may be utilized to provide an audio-visual indicator of an ignition spark within an automotive ignition system. This indicator apparatus is connected between the point of inquiry for the presence of spark and auto ground, components downstream from the point of inquiry normally being disconnected.

The spark indicator apparatus 100 includes a spark transmission cable having a first and second portion 101 and 103, respectively. This spark transmission cable can be of similar material to spark plug cables. As an example, it can be 7 millimeter stranded steel core wire with silicon or hypolon insulation. Each portion 101 and 103 may be of a length convenient for connecting the indicator apparatus 100 within the auto system. Typically, each portion 101 and 103 is 7 inches long.

Connected to a free end of the first cable portion 101 in electrical contact with the steel strands therewithin, is an allegator clip connector 105. This allegator clip connector 105 may be of a type similar to Muller number 48-B. A black rubber boot 107 surrounds and insulates the allegator clip connector 105. A test lead 109 is in electrical connection with the allegator clip connector 105 and extends along the first cable portion 101 beyond the rubber boot 107. This test lead is insulated wire typically 40 strands of 0.006 inch diameter wire, 4 feet long with a "Hollingworth's male bullet" in line connector at the end thereof. The bullet connector has either vinyl or nylon insulation surrounding it.

Connected to a free end of the second cable portion 103 is a female coil wire terminal connector 111 of the type used for mating with spark plug terminals. This coil wire terminal connector 111 may be of a type equivalent to "AMP Corporation number ASI-332416."

Encasing the remaining free ends of the first and second cable portions 101 and 103 is a housing having a first and second housing portions 113 and 115, respectively. The housing first and second portions 113 and 115 may be made of any electrically nonconductive translucent or transparent material. Typically, the portions 113 and 115 are made of clear Lexan™ poly carbonate material type 3412 as supplied by General Electric Company. This material is easily machinable or injection-molded to the desired shape for the housing portions.

Incident to assembly, the first and second housing portions 113 and 115 are ultrasonically welded after inserting the first and second cable portion assemblies 101 and 103. The shape of the housing formed by the joined housing portions 113 and 115 may be of many acceptable configurations. Typically, this housing is essentially rectangular. However, the housing may have rounded edge corners or sides. Such rounding of the exterior corners, edges, or sides of the housing may introduce an optical distortion of the visual presentation of the spark therethrough. One such distortion is magnification.

Figure 2:
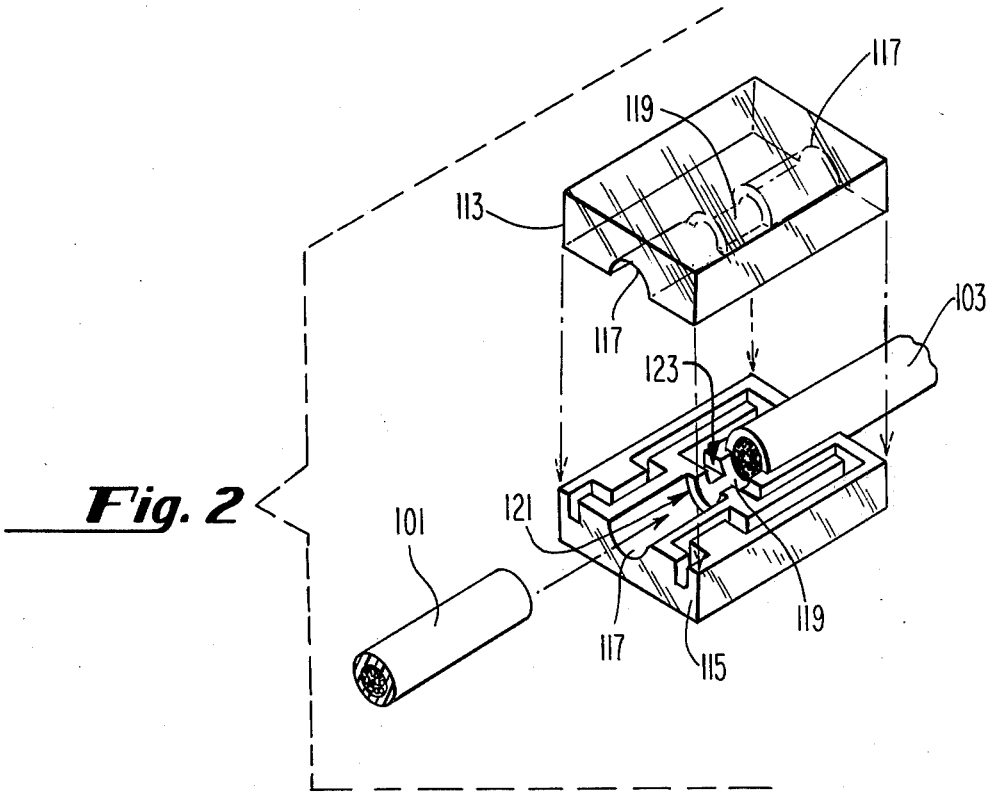
FIG. 2 is an expanded separated view of the apparatus of FIG. 1 at the housing and spark chamber portion thereof.

FIG. 2 shows an expanded view of the structural features of the first and second housing portions 113 and 115, and the cables 101 and 103 and additional elements comprising the spark indicator 100. The second housing portion 115 has a semi-circular canal extending through the surface of its mating face with the first housing 113. This canal has a larger radius canal portion 117 and a smaller radius canal portion 119. The larger radius canal portion 117 has in fact two sections, each extending inwardly from an outer face of said second housing portion 115. The smaller radius canal portion 119 connects the two larger radius canal portions 117 in contiguous fashion, so that a single straight canal is formed thereby, extending along a center line of the second housing portion 115 and transecting opposing faces of said second housing portion 115. The interface of either end of the smaller radius canal portion with the larger radius canal portion 117 sections defines an abutment shoulder 121 at each interface.

A like canal having like larger and smaller radius canal portions 117 and 119 extends into the mating face of the first housing portion 113 in like manner to portion 115. When the first and second housing portions 113 and 115 are joined together, a single cylindrical passageway is defined along the longitudinal center line of the housing. This passageway has larger diameter sections at either end and a smaller inner diameter section, all of which, are in alignment with one another.

A pair of identical ports 123 open into the smaller radius canal portion 119 of the second housing portion 115. Leading from each port 123 and extending along the surface of the mating face of the second housing portion 115 are a pair of rectangular canals 125 symmetric about the longitudinal axis of the housing. The canals 125 each extend along the surface of the second housing portion 115 in rectilinear maze fashion leading to an outer face of said second housing portion 115. The pathway of the rectilinear canals 125 contain 7 right angle turns. With the first and second housing portions 113 and 115 joined, the mating face of the first housing portion 113 forms a pair of rectilinear exhaust ports for venting the smaller center canal portion 119 to the atmosphere.

The housing is assembled with the first and second cable portions 101 and 103 inserted into the larger radius canal portions 117 to abut against the shoulders 121. The smaller radius canal portion 119 therefore defines a spark chamber of precise measurements. A predetermined fixed spark gap between the exposed spaced ends of the cable portions 101 and 103 is therefore defined. The exhaust passageways 123 vent the spark chamber to the atmosphere. The cable portions 101 and 103 may be glued, clamped or otherwise secured within the cable passageways, these passageways being defined by the joined larger radius canal portions 117 of the housing.

Figure 3A:
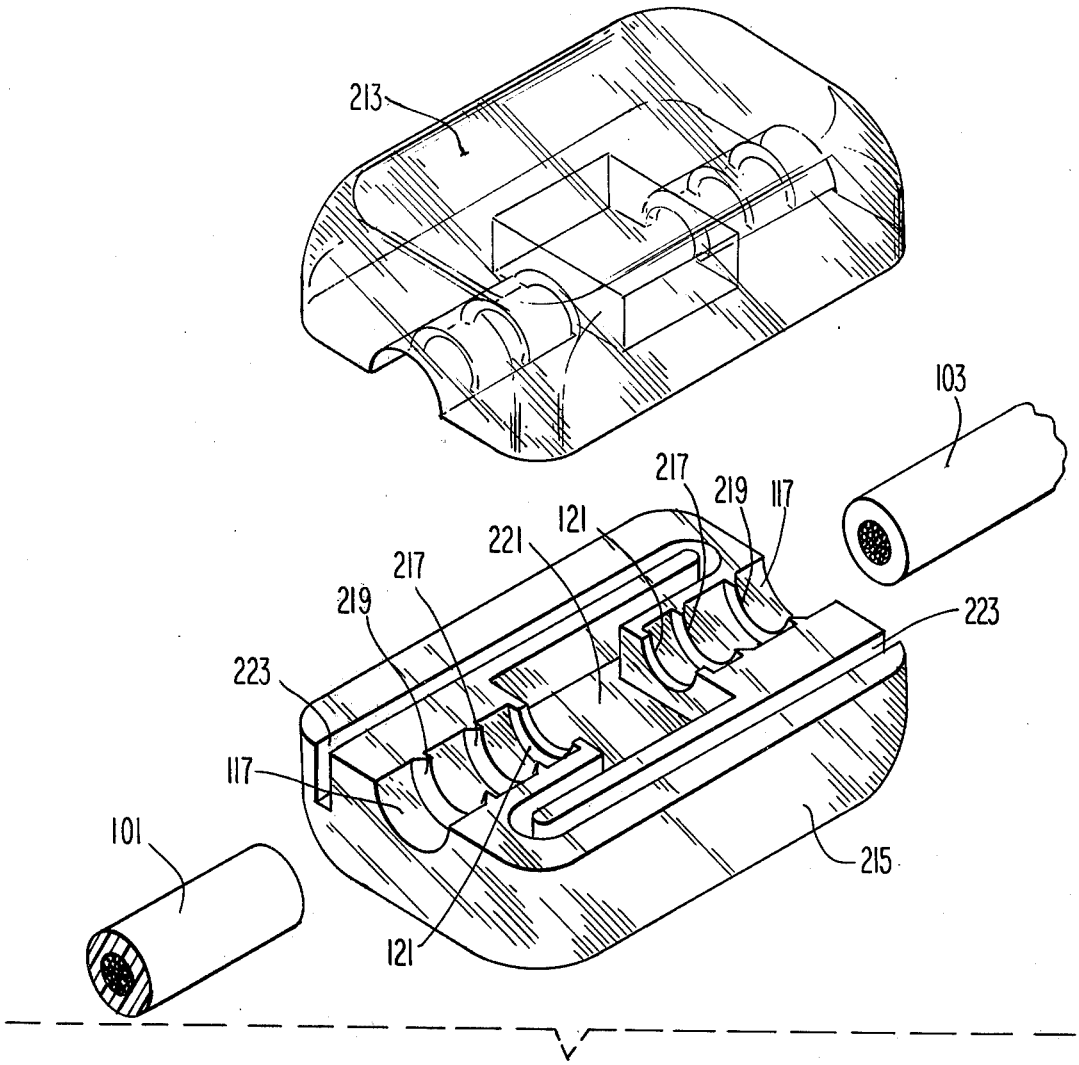
FIG. 3*a* is an expanded separated view of the housing and spark chamber portion of an alternate embodiment of the apparatus.

As an alternative embodiment, FIG. 3*a*, the housing may be constructed of a first and second complimenting housing portions 213 and 215. These portions may have rounded corners and surfaces, or may be made entirely semi-circular so that, when joined, they form a cylindrical housing. A cable passageway extends longitudinally through the housing formed by the joined portions 213 and 215. As in the preferred embodiment, this housing passageway includes a pair of larger radius canal portions 117 extending inwardly from opposing faces of the housings 213 and 215. The radial dimensions of these canal portions 117 being of a size to neatly accept the first and second cable portions 101 and 103. Located within each larger radius portion 117 is a pair of annular inner and outer barbs 217 and 219, respectively. The barbs 217 and 219 extend outwardly from the face of the canal 117 to impinge upon and crimp the insulation on the first and second cable portions 101 and 103 inserted therein to securedly hold these portions in place. Abutment shoulders 121 rise at the inward end of each larger radius canal portion 117 for abutting the end of the cable portions 101 and 103 for assuring full insertion of these cable portions 101 and 103.

This alternate embodiment, FIG. 3*a*, contains a rectangular cavity 221 having two identical half portions, each extending into the respective housing portions 213 and 215 from the mating faces thereof. This rectangular cavity 221 replaces the cylindrical spark chamber formed by the smaller radius portions 119 of the preferred embodiment. The longitudinal dimension of the rectangular cavity 221 defines the distance of separation between the ends of the cable portions 101 and 103 and provides an initial distance for the spark gap.

A pair of vent passageways 223, formed by a rectangular canal in the mating face of the second housing portion 215 and the mating of the corresponding face of the housing portion 213, meander through the housing to have at least one curvature and reversal in direction to access in outer face of the second housing portion 215 and thereby define the atmospheric vent passageway for the rectangular spark cavity 221. While the rectangular cavity atmospheric venting passageways 223 are identical in shape, they are reversely oriented to exit the housing on opposite sides.

As stated above, the performance of the spark is greatly affected by the distance of the spark gap. However, it is also greatly affected by the surfaces between which the spark must jump. In attempting to simulate a spark plug electrode structure, smooth electrode faces or cable ends are desirable. A pair of wire end caps 225, FIG. 3*b*, being "tack"-shaped with a flat circular head and a pointed shank extending perpendicularly therefrom, are insertable, one each, into the ends of the first and second cable portions 101 and 103. These end caps 225 may be inserted into the ends of the first and second cable portions 101 and 103 before they are installed in the housing. In which case, the flat head portions thereof abut the shoulders 121. Alternately, the wire end caps 225 may be inserted, one each, into a pair of annular grooves 227 in the housing adjacent to the abutment shoulders 121. The cable end portions at 101 and 103 may then be inserted into the housing portion without consideration for abutment directly against the shoulders 121 as long as the shank of the wire end caps 227 makes electrical contact with the conducting wire within the cable portions 101 and 103. Annular grooves 229 are of a rectangular or other cross-sectional shape adapted to receive the flat head portions of the wire end caps 225.

Figure 3C:
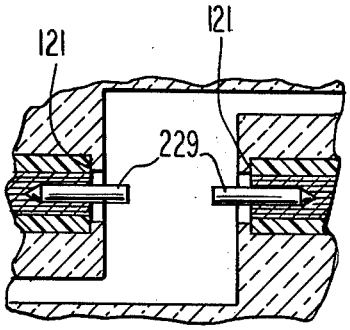
FIGS. 3*b* and 3*c* are sectional views, and are alternate embodiments of the spark chamber portion of FIG. 3*a*.
Figure 3B:
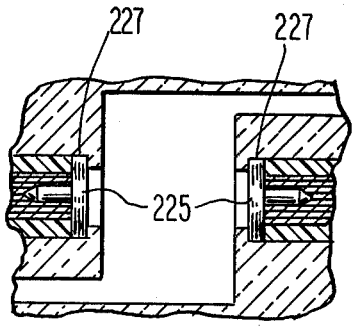

As alternatives to the wire end caps, a pair of electrode pins 229, FIG. 3*c*, may be inserted into the exposed ends of the first and second cable portions 101 and 103. These electrode pins 229 extend out of the end of the cable portions 101 and 103 a precise distance when those cable portions 101 and 103 ends are abutted against the shoulders 121. A precise air gap distance is therefore defined between the electrode pins 229.

Each of the embodiments described above contain a precise predetermined air gap distance between the electrodes, whether the electrodes be the open end of a cable portions 101 and 103, the flat surface of the wire end cap heads 225 or the end points of the electrode pins 229.

Many changes can be made in the embodiments presented without departing from the intent and scope thereof. For example, the shape of the air gap chamber can be changed as well as the shape of the air vent passageways. Alteration to the shape of these components will affect the audible "popping" sound heard when a spark occurs. The precise shape of the spark chamber and the air vent passageways can amplify or muffle the "pop" sound. By creating an outwardly flairing ever-enlarging atmospheric passageway similar to a trumpet, an amplification may be obtained. By incorporating additional bends in the atmospheric vent passageways or by introducing constrictions and expansion sections, muffling of the "pop" sound may be obtained. Differences in the curvature of the walls of the spark gap chamber and the outer surfaces of the housing create a lens effect. This lens effect can concentrate the lines of light emitted by a spark or diffuse them to present varying optical presentations to the viewer. A magnification of the spark may be obtained, or a concentration of the spark lines which makes the light brighter, may be obtained. All of these alterations in the design, while not illustrated in the accompanying drawings, are intended to be part of the invention.

Moreover, many alternate embodiments may also be made of the cable portions 101 and 103 ends and electrode pins 229. For example, instead of the pins 229 being separate components of the assembly, they may be integrally created by extending one strand of the seven strands of the cables 101 and 103. Alternately, the shoulders 121 may be made of such a size to expose only one strand of the strands within the cables 101 and 103.

The apparatus as disclosed, including all of its embodiments, provides a strong positive audio and visual indication of the presence of ignition spark. By analyzing the strength of the visual signal, and the strength of the audio signal, a qualitative analysis of the condition of the spark may easily be determined by the automotive mechanic. The device therefore is capable of providing these indications even when used in the noisy, poorly lighted surroundings typically found in an automotive garage.

What is claimed:

1. A spark indicator apparatus for use in detecting automotive ignition spark at various points in an auto ignition system comprising:

electrical transmission means for electrically connecting a one of said various ignition system points to automotive ground, said transmission means having an interruption therein providing a spark air gap;

means for encasing said spark air gap, said encasing means including a transparent housing completely surrounding said spark air gap, a straight channel passing through said housing, said channel having two larger diameter sections and a smaller diameter section separating said two larger diameter sections, and a pair of abutment shoulders, situated one each at an interface of said smaller diameter channel section with one of said two larger diameter sections; and means for venting said spark air gap through said encasing means, said venting means traversing at least one change in direction.

2. The apparatus of claim 1 wherein said electrical transmission means includes a first and second cable portions connected one each through one of said larger diameter channel sections to abut a respective one of said abuttment shoulders, said first and second cable portions being spaced apart creating said air gap therebetween.

3. The apparatus of claim 1 wherein said electrical transmission means includes:

a first cable portion extending through a first one of said larger diameter sections of said channel;

a second cable portion extending through the other one of said larger diameter sections of said channel;

a first end cap having a flat head abutting a first one of said abuttment shoulders and having a connection spike extending from said head connected to said first cable portion; and a second end cap having a flat head abutting the other one of said abuttment shoulders and having a connection spike extending from said head connected to said second cable portion.

4. The apparatus of claim 3 wherein said venting means includes:

a pair of ports opening into said small diameter channel section; and a pair of rectangular cross-section passageways extending one each from each of said ports about the longitudinal axis of said housing, said passageways each traversing at least one change in direction to an outer face of said housing.

5. The apparatus of claim 4 wherein said first larger diameter channel section includes a first traverse groove section, said first groove being positioned to hold said first end cap at said first abuttment shoulder; and wherein said other larger diameter channel section includes a second traverse groove, said second groove being positioned to hold said other end cap at said other abuttment shoulder.

6. The apparatus of claim 5 wherein said pair of passageways each traverses a rectalinear path, said paths each containing a plurality of right angle turns.

7. The apparatus of claim 6 wherein each said passageway plurality of turns is seven.

8. The apparatus of claim 7 also including a first barb extending from said first one of said larger channel sections and holding said first cable portion; and a second barb extending from said other one of said larger channel sections and holding said second cable portion.

9. The appartus of claim 2 also including a rectangular chamber within said housing, said rectangular chamber extending through and opening onto said smaller diameter channel section; and wherein said venting means is connected to said rectangular chamber.

10. The apparatus of claim 1 wherein said electrical transmission means includes a first and second cable portions having one end of each juxtaposed and spaced from the other, said space defining said spark air gap, said first and second cable portions each having an insulation covering with a protruding conductor on its juxtaposed end; and wherein said encasing means includes a transparent rectangular housing completely surrounding said spark air gap; a straight channel passing through said housing, said channel having two larger diameter sections opening onto opposite walls of said housing and two smaller diameter sections extending inwardly one each from the inward end of each larger diameter section; a rectangular chamber surrounding said air gap, said rectangular chamber interposed between and connecting said two smaller diameter channel sections; and a pair of abuttment shoulders, situated one each at each interface of a said smaller diameter channel section with a said larger diameter channel section, each said abutment shoulder acting as an abuttment stop against which one said juxtaposed cable portion end abuts; and wherein said venting means includes a pair of vent passageways extending between opposing walls of said rectangular chamber and opposing outer walls of said housing, said passageways each traversing at least one reversal in direction.

* * * * *